United States Patent [19]

Ogasawara

[11] Patent Number: 5,065,079

[45] Date of Patent: Nov. 12, 1991

[54] METHOD AND APPARATUS FOR CONTROLLING LUMBAR SUPPORT DEVICE

[75] Inventor: Hiromitsu Ogasawara, Akishima, Japan

[73] Assignee: Tachi-S Co., Ltd., Tokyo, Japan

[21] Appl. No.: 601,464

[22] Filed: Oct. 23, 1990

[51] Int. Cl.[5] ..... H02P 1/22

[52] U.S. Cl. ..... 318/281; 297/284

[58] Field of Search ..... 318/114, 119, 126, 127, 318/128, 129, 134, 280, 281, 503, 519, 558; 297/284, 307, 353, 383, DIG. 9

[56] References Cited

U.S. PATENT DOCUMENTS

| | | | |
|---|---|---|---|
| 4,467,252 | 8/1984 | Takeda et al. | 318/603 |
| 4,840,425 | 6/1989 | Noble | 297/284 |
| 4,938,528 | 7/1990 | Scott | 297/284 |
| 4,940,284 | 7/1990 | Nagasaka | 297/284 |
| 4,944,554 | 7/1990 | Gross et al. | 297/284 |
| 4,950,032 | 8/1990 | Nagasaka | 297/284 |
| 4,966,410 | 10/1990 | Bishai | 297/284 |
| 4,981,131 | 1/1991 | Hazard | 128/38 |

*Primary Examiner*—Bentsu Ro

*Attorney, Agent, or Firm*—Oldham & Oldham Co.

[57] ABSTRACT

A method and apparatus for controlling a lumbar support device provided in the seat back of an automotive seat. The control for support against the lumbar of an occupant on the seat is effected through manual and automatic control modes, and the automatic control mode emits alternating pulses for causing repeated alternating series of normal and reverse drives of a motor, to thereby move a lumbar support plate reciprocally forwards and backwards, offering a massage effect to the occupant's lumbar part.

8 Claims, 3 Drawing Sheets

METHOD AND APPARATUS FOR CONTROLLING LUMBAR SUPPORT DEVICE

BACKGROUND OF THE INVENTION

1. Field of the Invention

The present invention relates to a control of a lumbar support device for use in an automotive seat, and particularly is directed to a method and apparatus for controlling the lumbar support device to effect adjustment fore-and-aft positions of the lumbar support plate of the device at a desired support pressure against the lumbar support of an occupant on the seat for reducing his or her fatigue.

2. Description of Prior Art

Powered type of lumbar support device is actuated under a control of motor therein so as to adjust a pressure degree of the support plate against the lumbar part of an occupant on the seat. The adjustment is made through a switching operation.

In a great lengthy of time for driving an automobile provided with such lumbar support device, the occupant becomes tired with sitting on the seat, with a fatigue developing to make him or her feel uncomfortable with a preset lumbar support force.

However, in the hitherto powered lumbar support device, the lumbar support force is a fixed one that gives a simple degree of pressure force to the lumbar part of the occupant. This is not the answer to fully alleviate the fatigue of the occupant.

SUMMARY OF THE INVENTION

With the above drawback in view, it is a purpose of the present invention to provide a method and apparatus for controlling a lumbar support device which permits for alleviating a fatigue of an occupant on a seat including the device.

For that purpose, the present invention provides a selective choice between manual and automatic control for the lumbar support device, and in particular, in the automatic control, an alternating series of rectangular pulses are output into each of two relay means, so that a motor connected with the relay means is driven for normal and reverse rotations in alternative manner, thereby causing a lumbar support plate of the device to move forwardly and backwardly in a repeated, reciprocal manner. This offers a massage effect to the lumbar part of an occupant on the seat, and so alleviates his or her fatigue during a long time of driving the automobile.

In one aspect of the invention, the rectangular pulses may be adjusted in pulse generating period and pulse width, by incorporating relevant variable resistances and condensers in a proper electric circuit arrangement. The pressing periodicity of the lumbar support plate may be adjusted steplessly by setting a desired period of the pulses, or the pressing force of the plate may be adjusted by setting a pulse duty ratio, i.e. the pulse width. Those two adjustments may be effected independently of each other.

DETAILED DESCRIPTION OF PREFERRED EMBODIMENT OF THE INVENTION

Figure 1:
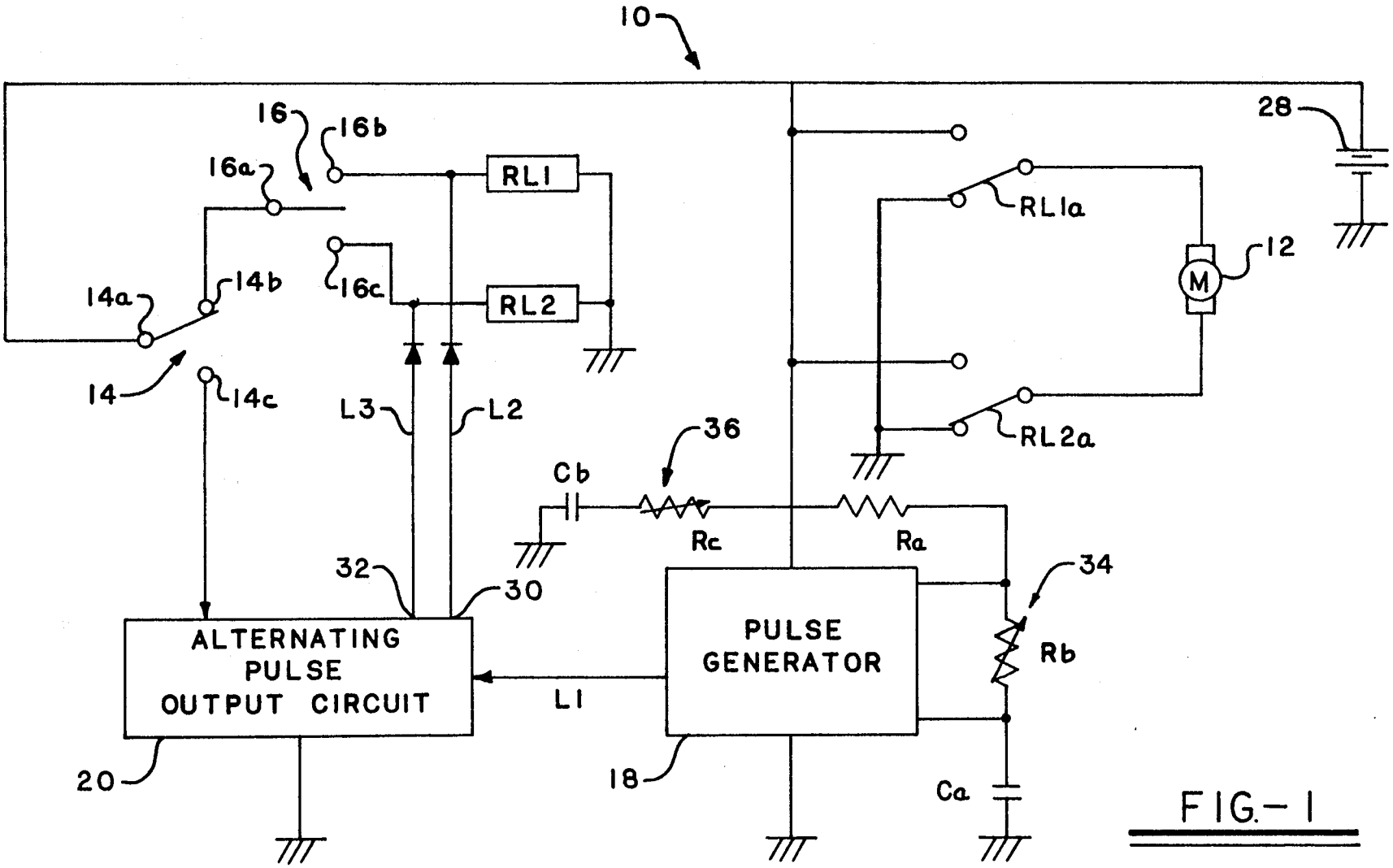
FIG. 1 is a schematic block diagram of circuit for control of lumbar support device in accordance with the present invention.
Figure 2:
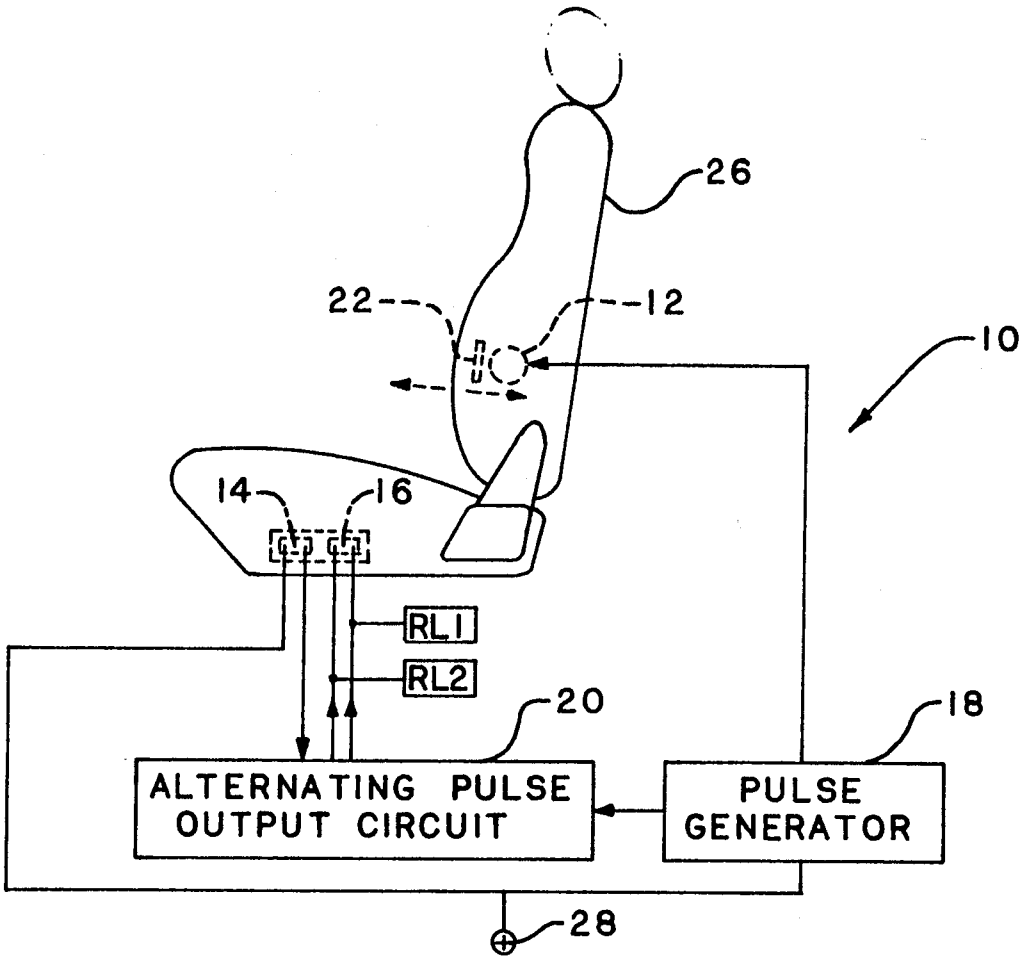
FIG. 2 is a schematic diagram showing a relation between the circuit and seat.

Reviewing FIGS. 1 and 2 indicates an embodiment of a lumbar support control device (10) which includes a motor (12), a selection switch (14), a manual switch (16), a pulse generator (18) and an alternating pulse output circuit (20), basically. The motor is preferably a DC geared motor.

As in FIG. 2, a lumbar support plate (22) is shown to be provided in a seat back (26) of a driver seat (24), with an associated drive mechanism (not shown) being provided together therewith, such as to give a pressure, as the plate (22) is moved forwardly, against the lumbar part of an occupant on the seat. Those elements are a known one of any structure that permits fore-and-aft movement of the plate (22) relative to the seat back (26).

Referring to FIG. 1, the selection switch (14) includes a main contact (14*a*) to be able to contact either of first and second contact points (14*b*)(14*c*) (i.e. a see-saw type switch).

The contact (14*a*) is connected to a power source (24) for selectively flowing current into one of the tow points (14*b*)(14*c*).

The manual switch (16) also includes a main contact (16*a*) capable of contact with one of first and second contact points (16*b*)(16*c*), preferably a see-saw type switch. The main contact (16*a*) is connected to the first point (14*b*) of the selection switch (14), thus forming a manual control side of the latter.

As shown, first and second relays (RL1)(RL2) are provided, and connected with the points (14*b*)(14*c*) of the manual switch, respectively. The two relays have relay contacts (RL1a)(RL1b), respectively, which are in turn connected to the motor (12), whereby the rotation of the motor (12) is changed over by operation of the manual switch (14) via those relay mechanisms. Specifically, to make the main contact (16*a*) in contact with the second point (16*b*) will allow flow of current into the motor (12) through the first relay (RL1, RL1a), thus rotating the motor in a normal direction for causing forward movement of the lumbar support plate (22), or to bring the main contact (16*a*) to contact with the second point (16*c*) will result in a reverse rotation of the motor (12) through the second relay (RL2, RL2a) for causing backward movement of the plate (22). This is a manual adjustment through switching-over of the selection switch (14) to the manual side point (14*b*).

Figure 3:
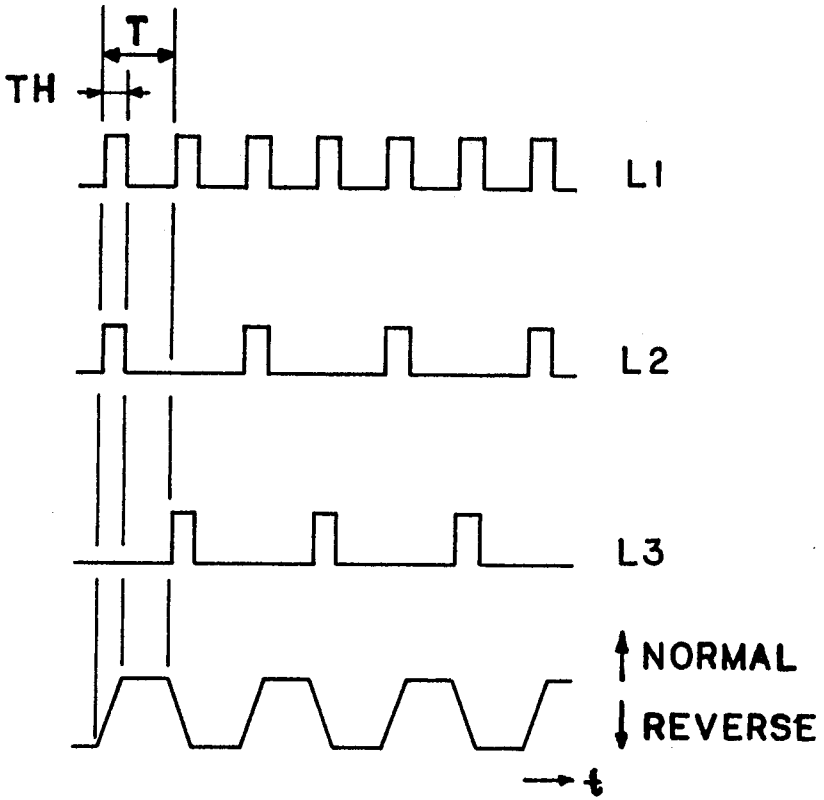

The pulse generator (18), preferably a timer IC, is connected with the power source (28), and generates a rectangular pulse of a given period and width from an electrical input from the source (28), as seen in FIG. 3, thus supplying a proper pulse into the alternating pulse output circuit (20).

The alternating pulse output circuit (20) has a first output terminal (30) and a second one (32), each being connected with the first and second relays (RL1)(RL2), respectively, via a first line (L2) and second line (L3). Looking now at FIGS. 1 and 3, plural pulses from the generator (18) are distributed alternately to each of the first and second line (L3) through that circuit (20), thereby conveying a certain series of pulses, alternately, to each of the two relays (RL1, RL2). This alternate pulse sending is effected irrespective of the operation of the manual switch (16).

The input terminal of the alternating pulse out circuit (20) is connected with the foregoing point (14c) of the selecting switch (14), which serves as an "auto" switch meant to permit alternating switch-over of the two relays (RL1, RL2) automatically. Thus, to turn on the point (14c) will block the above-stated manual switch (16), and place the circuit (20) in "on" state. In this auto-switch mode, referring to FIGS. 1 and 3, the pulses from the generator (18) are sent through the line (L1) and alternately distributed by the circuit (20) into each of the first and second lines (L2)(L3), thereby carrying out the corresponding alternate switching-over of the relays (RL1, RL2) at a time length equal to the width of each pulse, and causing normal and reverse rotation of the motor (12) in an alternate manner at a given time equal to each pulse width.

Accordingly, as indicated by the arrow in FIG. 2, the lumbar support plate (22) is reciprocated forwardly and backwardly by such alternate drive system, like a piston motion, such that the plate (22) is advanced and withdrawn at a distance corresponding to the pulse width, thereby providing a repeated pressing motion under a certain pulse period against the lumbar part of an occupant on the seat, hence effecting a massage there. In contrast to the conventional simple pressing manner, the lumbar support force accompanies a massage effect and is effective in alleviating a fatigue of the occupant.

The pulse-based lumbar support system in the present invention may be directly incorporated in a known lumbar support mechanisms, in order to simplify the structure of device.

Referring to FIG. 1, the pulse generator (18) is connected with an intermediate resistance (Ra), a variable resistance (Rb) for adjustment of pressing periodicity, another variable resistance (Rc) for adjustment of pressing degree, and two condensers (Ca)(Cb), as illustrated. In this case, the pulse generating period (T) is determined by the following formula:

$$T \approx \frac{(Ra + 2Rb)Ca}{1.44}$$

and, the pulse width (tH) is determined by the following formula:

$$t_H = \frac{1.6Rc \times Cb}{(Ra + 2Rb)Ca} \times T$$

Consequently, the pressing periodicity of the lumbar support plate (22) is set by means of the first formal, and the pressing degree or pressing force of the plate (22) is obtained by dividing the value of $t_H$ in the second formula by the value of T in the first formula (i.e. $t_H/T$, a pulse duty ratio)

Figure 4:
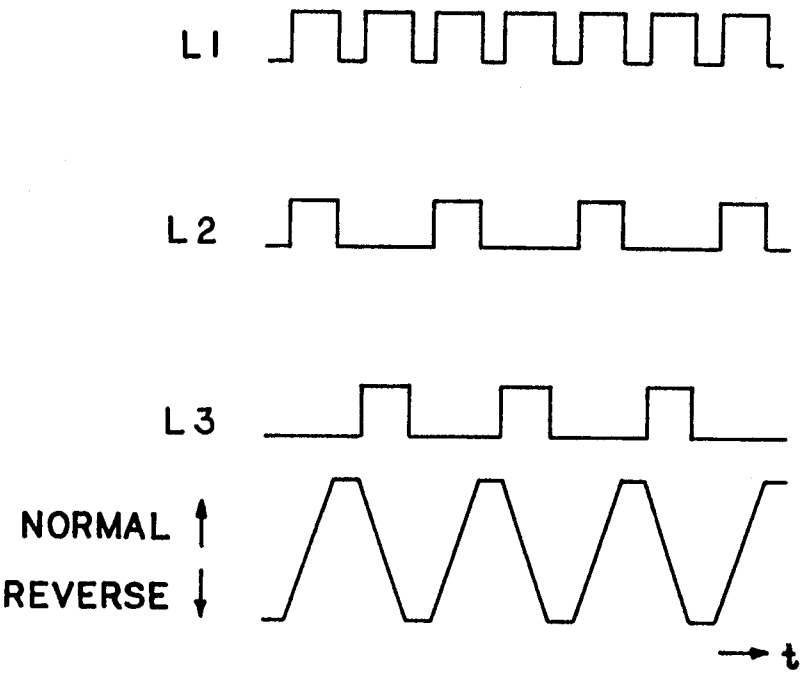
FIG. 3 and 4 are time chart of pulses for producing alternating signals to a motor.

As can be seen from FIG. 4, if the resistance value of the second resistance (Rc) is increased, the width of pulse being generated becomes greater, which is effected independently of the adjustment of the first resistance (Rb). Thus, the motor (12) is driven alternately in normal and reverse direction at an increased distance corresponding to such increased pulse width, offering an increased pressing force through the plate (22).

As regards the first resistance (Rb), the increase of its resistance value will increase the number of pressing.

It is seen that the pressing force and pressing number of the lumbar support plate (22) can be adjusted independently of each other and steplessly by means of the foregoing two adjustment means (Rc, Rb), so as to give an optimal support force to the occupant, considering the degree of his or her fatigue, hence insuring to alleviate a fatigue having developed from a long time of sitting on the seat.

The present invention is not limited to the illustrated embodiment, and other modifications, replacements and additions may structurally be possible without departing from the spirit and scope of the appended claims.

What is claimed is:

1. A method for controlling a lumbar support device to adjust a lumbar support plate forwardly and backwardly under control of a motor against a lumbar part of an occupant on a seat, said method comprising the steps of:

permitting selective choice between a manual control and an automatic control by use of a selection switch;

adjusting, through said manual control, the forward and backward position of said lumbar support plate by means of a switch-over operation for causing a corresponding normal and reverse drive of said motor; and causing said motor, through said automatic control, to drive in normal and reverse directions alternately in a repeated manner by means of generating plural rectangular pulses each having a given generating period and pulse width and distributing them alternately into each of two relays which in turn causes alternate normal and reverse drive of said motor in response to each of alternately sent said pulses, to thereby move said lumbar support plate forwardly and backwardly in a repeated alternate manner.

2. The method as defined in claim 1, wherein said manual control is effected by a manual switch having two contact points each being connected with the respective two relays, wherein said automatic control is effected by bringing a contact element of said selection switch into contact with a contact point connected with a means for outputting said rectangular pulses alternately into each of said two relays.

3. The method as defined in claim 2, wherein said pulses are generated from a pulse generator connected electrically with a power source, and wherein said outputting means comprises an alternating pulse output circuit, whereby, in said automatic control, said pulses from said generator are distributed by said alternating pulse output circuit, alternately, into each of said tow relays, thereby causing said motor to rotate in normal and reverse directions alternately in said repeated manner.

4. The method as defined in claim 3, wherein said method further comprising step of permitting variation of said generating period and width of said pulses being generated from said pulse generator, so as to adjust a pressing periodicity and pressing force of said lumbar support plate against said lumbar part of said occupant.

5. The method as defined in claim 4, wherein said variation of said generating period and width of said pulses is effected from each of corresponding pair of variable resistances and condensers which are arranged to be electrically connected with said pulse generator, with a resistance interposed between said pair of variable resistances and condensers, and wherein said generating period is determined by a formula:

$$T \approx \frac{(Ra + 2Rb)Ca}{1.44} \quad (1)$$

wherein said T refers to said generating period, said Ra and Rb refer to said variable resistances, and said Ca refers to one of said condensers; and, said pressing force is determined by a pulse duty ratio obtainable from following formulas:

$$tH/T$$

wherein said tM refers to said pulse width, expressed by following formula:

$$t_H = \frac{1.6Rc \times Cb}{(Ra + 2Rb)Ca} \times T$$

wherein said T refers to said pulse generating period expressed by said first formula (1) and said Ra, Rb, Rc, Ca and Cb refer to said variable resistances and condensers, respectively.

6. An apparatus for controlling a lumbar support device, which is provided within a seat, comprising:

a lumbar support plate disposed within a seat back of said seat, said lumbar support plate being movable forwardly and backwardly relative to said seat back, thereby adjustably supporting a lumbar part of an occupant;

a motor for causing forward and backward movement of said lumber support plate;

a pulse generator for generating rectangular pulses each having a predetermined generating period and pulse width;

an alternating pulse output circuit which receives said pulses from said pulse generator and then distributes them alternately, outputting each of them through two output terminals thereof;

a selection switch for permitting selective choice between a manual control and an automatic control; and a manual switch connected with a manual contact point of said selection switch, said manual switch being further connected with relays for causing normal and reverse drive of said motor, wherein, when switching over said selection switch into contact with said manual contact point, said motor is controlled manually by operation of said manual switch for either of normal and reverse rotation, to thereby permit adjustment of said lumbar support plate in said forward and backward direction, whereas, when switching over said selection switch into contact with an automatic contact point, said pulses are allowed to flow alternately into said relays, thereby causing repeated series of normal and reverse drives of said motor, so as to cause reciprocal repeated forward and backward of said lumbar support plate under a predetermined pressing periodicity and pressing force.

7. The apparatus as defined in claim 6, wherein said apparatus further comprises a pulse period adjustment means for adjusting a generating period of said pulses at a desired degree; and a pulse duty ratio adjustment means for adjusting a duty ratio of said pulses, such that the pulse generating period and the duty ratio are to be adjusted independently of each other.

8. The apparatus as defined in claim 7, wherein said pulse period adjust means and said pulsed duty ratio adjustment means, each comprises a pair of variable resistance and condenser, which are connected with said pulse generator.

* * * * *